US005640182A

United States Patent [19]

Bahrami et al.

[11] Patent Number: 5,640,182

[45] Date of Patent: Jun. 17, 1997

[54] UNIVERSAL INK-JET PRINTHEAD MAINTENANCE STATION

[75] Inventors: Hassan Bahrami; David Michael Cseledy, both of Lexington; Paul Harrington, III, Versailles; Edmund Hulin James, III, Lexington, all of Ky.

[73] Assignee: Lexmark International, Inc., Lexington, Ky.

[21] Appl. No.: 327,935

[22] Filed: Oct. 24, 1994

[51] Int. Cl.[6] ..... B41J 2/165

[52] U.S. Cl. ..... 347/33; 15/250.48; 347/23; 347/24

[58] Field of Search ..... 347/22, 23, 33, 347/24; 15/250.1, 250.4, 250.41, 250.48, 245, 256.5

[56] References Cited

U.S. PATENT DOCUMENTS

| | | | |
|---|---|---|---|
| 4,473,919 | 10/1984 | Fritz, Jr. | 15/250.48 |
| 5,146,243 | 9/1992 | English et al. | 346/140 R |
| 5,151,715 | 9/1992 | Ward et al. | 346/140 R |
| 5,155,497 | 10/1992 | Martin et al. | 346/1.1 |
| 5,216,449 | 6/1993 | English | 346/140 R |
| 5,423,105 | 6/1995 | Scott | 15/250.41 |

FOREIGN PATENT DOCUMENTS

| | | | |
|---|---|---|---|
| 854122 | 1/1940 | France | 15/250.4 |
| 2313743 | 10/1974 | Germany | 15/250.48 |
| 2627832 | 1/1976 | Germany | 15/250.41 |
| 1-174458 | 7/1989 | Japan | 347/33 |

*Primary Examiner*—John E. Barlow, Jr.
*Attorney, Agent, or Firm*—John J. McArdle, Jr.; Ronald K. Aust

[57] ABSTRACT

A maintenance station for maintaining either a monochrome or a multi-color printhead in an ink-jet printer includes a single flexible wiper having a first wiping edge for wiping the ink-jet nozzle surface of a monochrome printhead and a plurality of second wiping edges for wiping the ink-jet nozzle surface of a multi-color printhead. Wiping of a monochrome printhead is accomplished by moving the printhead to one side of the wiper, raising the wiper into the path of travel of the nozzle surface, and moving the printhead past the wiper. Wiping of a multi-color printhead is accomplished in a similar manner but the printhead is first positioned on the opposite side of the wiper. The flexibility of the wiper is chosen to apply an optimum wiping force to a multi-color printhead as the printhead is moved past the wiper. A backstop is provided at one side of the wiper to brace it against deflection, so that the wiper applies a greater wiping force to a monochrome printhead than it does to a multi-color printhead. A microprocessor based controller senses the type of printhead and executes a first or a second maintenance routine depending on the type of printhead that is present in the printer.

21 Claims, 7 Drawing Sheets

| Fig. 7A | Fig. 7B |
|---|---|

UNIVERSAL INK-JET PRINTHEAD MAINTENANCE STATION

RELATED APPLICATIONS

This application incorporates by reference the disclosures of the applications of Monty L. Francis et al. Ser. Nos. 08/143,210 abandoned and 08/143,328, U.S. Pat. No. 5,563,637, assigned to the same assignee as this application.

1. Field of the Invention

The present invention relates to ink-jet printers for multi-color or monochrome printing. More particularly, the present invention relates to a maintenance assembly, a novel printhead wiper, and a control system for operating the maintenance station so that a single wiper and maintenance station may be utilized for wiping and capping either a multi-color or a monochrome printhead.

2. Background of the Invention

In existing printhead maintenance mechanisms used in ink-jet printers, either each color of the printhead has a separate maintenance assembly or, if all of the colors are housed in one printhead and the monochrome (usually black) housed in another printhead, the two printheads each have a separate maintenance assembly. This is true regardless of whether the color printhead and the black printhead reside in the printer at the same time or if the two printheads are interchangeably mounted on a single printhead carrier.

As described in copending application Ser. No. 08/143,328, a printhead maintenance assembly comprises (1) a cap assembly which can be moved to seal around the exterior of the printhead nozzle surface while staying as far away from the nozzles as possible so as to provide an environment in which drying air is excluded while the nozzles are capped, (2) a wiper that can be raised to engage the nozzle surface of the printhead and clear away ink, debris and undesirable matter collected on the surface of the nozzle plate area, and lowered when wiping is not desired, (3) a "spit cup" for receiving ink ejected from the nozzles to remove contaminated ink from the nozzles and maintain less used nozzles in proper working order, (4) a selectively energizable drive assembly including a gear train for moving the cap, wiper and spit cup and (5) an absorption pad for maintaining liquid ink so that the printer may be transported without damaging or soiling parts of the printer with purged ink.

In order for a single printhead maintenance system to operate satisfactorily during color and monochrome printing, it must be capable of responding to the different needs of the printhead geometry presented to it. For example, water resistant monochrome ink typically requires little spitting maintenance but requires a significant wiping force to be exerted to wipe the fast drying ink from the nozzle plate area. On the other hand, a tri-color printhead with its smaller nozzles and slower drying ink requires many more spits and wipes, but because the wiping is more frequent and the ink is slower drying, a lighter wiping force is preferred. Also, a tri-color printhead poses the problem of wiping the ink and debris from the nozzle surface without transferring ink of one color to the area of the nozzles that eject ink of another color.

BRIEF SUMMARY OF THE INVENTION

An object of the present invention is to provide a wiper for wiping either multi-color or monochrome ink-jet printheads without causing an intermixing of inks.

Another object of the invention is to provide a printhead wiper having three wiping edges for wiping a tri-color ink-jet printhead and a fourth wiping edge for wiping a monochrome ink-jet printhead.

A further object of the invention is to provide a printhead wiper assembly for wiping ink-jet printheads, the wiper assembly comprising a wiper including a body having a beam portion and a head portion, the head portion having first and second non-coplanar upper surfaces and side surfaces diverging from the beam portion and intersecting the non-coplanar upper surfaces at acute angles to form at least three printhead wiping edges.

Still another object of the invention is to provide a printhead wiper assembly as described above wherein all of the side surfaces diverge from a first side of the beam portion.

Yet another object of the invention is to provide a printhead wiper assembly as described above wherein the head portion has a further side surface diverging from a second side of the beam portion and intersecting one of the non-coplanar upper surfaces at an acute angle to form a fourth printhead wiping edge.

In accordance with another aspect of the invention, a programmable microprocessor is provided for controlling lateral movement of an ink-jet printhead and vertical movement of the wiper into the path traversed by the printhead so that three wiper edges one on side of the wiper wipe the nozzle plate of a tri-color printhead and a fourth wiping edge on the other side of the wiper wipes the nozzle plate of a monochrome printhead. In addition to controlling movement of the printhead and wiper so that wiping is always in one direction across a tri-color printhead and in the opposite direction for a monochrome printhead, the microprocessor variably controls, depending on the type of printhead installed, the numbering of wipes and spits at printer-on-reset, the number of nozzle fires between successive maintenance cycles, the number of pages between maintenance cycles, the idle time before a maintenance cycle is initiated, the number of spits for each color during a maintenance cycle and the number of spits and wipes upon a change in printheads.

In accordance with a further aspect of the invention, a wiper assembly for wiping either color or monochrome printheads comprises a flexible wiper having a first wiping edge for wiping a monochrome printhead as the printhead moves in a first direction relative to the wiper and further wiping edges for wiping a multi-color printhead as the printhead moves in the opposite direction relative to the wiper, and a backstop acting against the wiper as the wiper is deflected by a monochrome printhead, so that a higher wiping force is applied to a monochrome printhead than is applied to a multi-color printhead.

Other objects of the invention and the manner of making and using it will become obvious upon consideration of the following description and the accompanying drawings.

DESCRIPTION OF PREFERRED EMBODIMENTS

Figure 1:
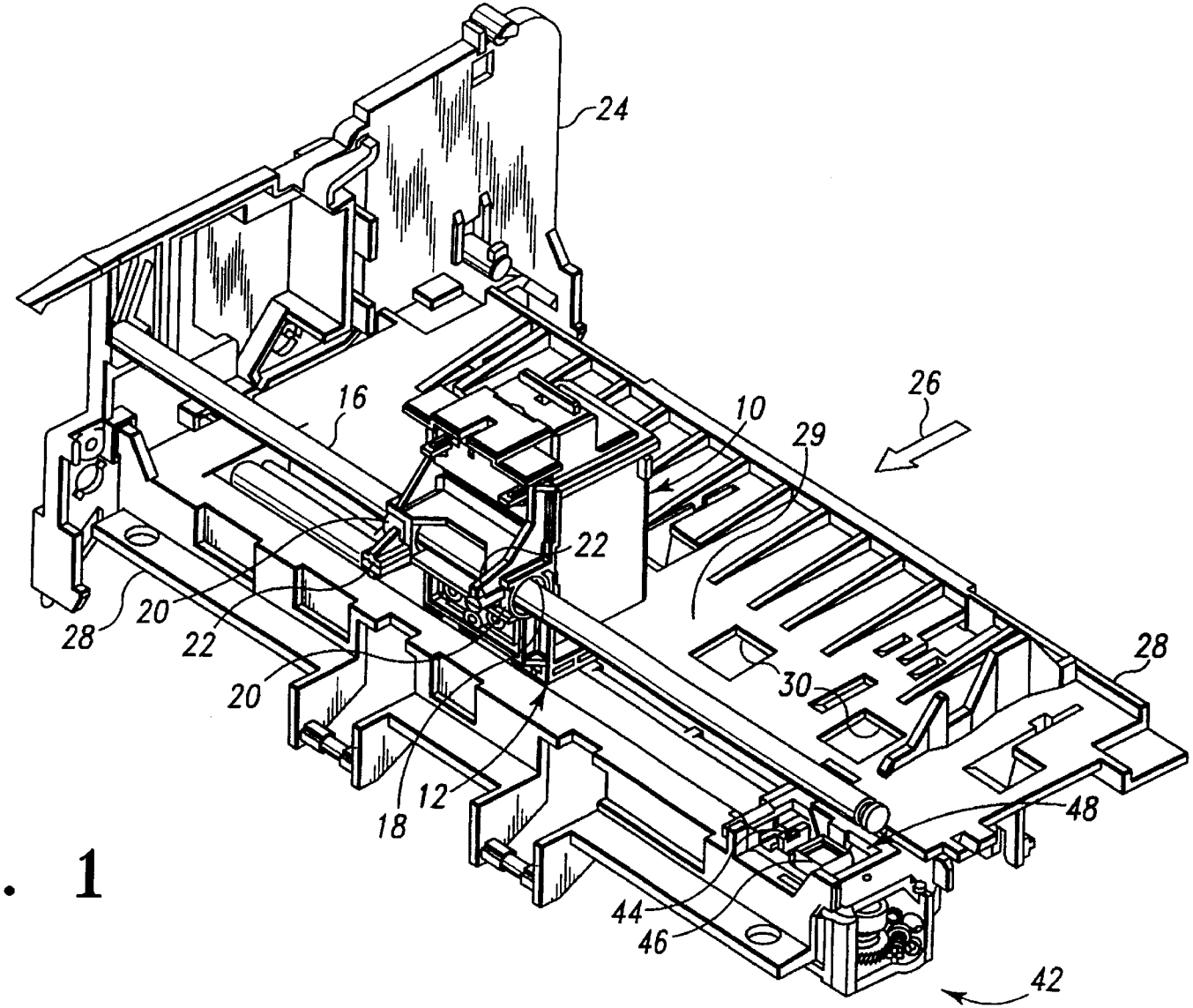
FIG. 1 is a perspective view of a portion of a printer showing an ink-jet printhead and a maintenance station for the printhead.
Figure 4A:
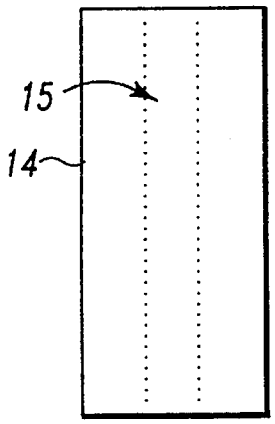
FIGS. 4A and 4B are plan views of typical nozzle plates for a monochrome and a tri-color printhead, respectively, looking at the surfaces from which ink is ejected.

In FIG. 1 a printhead 10 is mounted on a printhead carrier assembly 12. The printhead 10 is conventional in that it comprises a cartridge having a plurality of ink-jet nozzles located in a nozzle plate, and an ink supply and controls (not shown) for controlling the nozzles to eject ink therefrom. The printhead 10 is removable and interchangeable and may be either a monochrome cartridge having a single ink supply and nozzle plate 14 (FIG. 4A) mounted on its bottom surface, the nozzle plate having one or more rows of ink-jet nozzles 15, or a tri-color cartridge having ink supplies of three different colors and a nozzle plate 14' (FIG. 4B) with three groups of ink-jet nozzles $17^1$, $17^2$, $17^3$ for ejecting the inks.

The carrier assembly 12 is supported on a guide rod 16 by slide bearings 18 housed within two bearing housings 20. The carrier assembly includes two sets of belt gripper jaws 22. The gripper jaws, together with a belt (not shown) driven by a bi-directional motor 33 (FIG. 2), comprise a means for moving the carrier assembly and printhead back and forth along guide rod 16.

The guide rod 16 is supported by two side frames 24, only one of which is shown. The guide rod extends transverse to the direction of record feed, indicated by arrow 26, and is located above the record feed path. A molded plastic bed plate or middle frame 28 is mounted between side plates 24 and has an upper surface 29 which defines the lower side of the record feed path. A record sheet is advanced through the printer by feed rolls (not shown) in a conventional manner. Middle frame 28 is provided with a plurality of holes 30 so that feed rolls located below the frame may coact with feed rolls above the frame to feed a record sheet along the top surface of the middle frame and under a guide rail (not shown). As explained in copending application Ser. No. 08/143,328, U.S. Pat. No. 5,563,637, a guide rail is provided with a groove in which two feet of the carrier assembly 12 ride as the carrier assembly is moved back and forth over the record feed path, and an elongated plastic leaf spring presses a record upwardly against the bottom of the guide rail so that the upper surface of the record is a fixed distance from the nozzle plate 14 or 14' as the record passes under the nozzles.

Printing takes place in a conventional manner. As a record sheet is fed under printhead 10 in the direction of arrow 26, the printhead carrier assembly is moved back and forth over the record sheet as ink within the printhead is ejected from the nozzles. Data to be printed is received by an Application Specific Integrated Circuit (ASIC) 35 (FIG. 2) which converts or reformats the data and sends electrical signals to the printhead to control ejection of ink from the nozzles.

A maintenance or cleaning station 42 is provided for cleaning nozzles 15 or $17^1$, $17^2$, $17^3$ and capping them, that is, forming an air tight seal around them to prevent ink from drying in them. As shown in FIG. 1, the maintenance station 42 is suspended from middle frame 28 at one side of, and below, the record feed path. The maintenance station includes a wiper 44 and a cup-shaped cap 46. Briefly, wiping comprises raising the wiper 44 until it extends into the path of the printhead surface containing the nozzle plate, and moving the printhead past the wiper so that the wiper is deflected and an edge of the wiper wipes the surface of the nozzle plate from which the ink is ejected. Accumulated ink and other foreign matter is wiped from the printhead as the printhead moves past the wiper.

In a capping operation the printhead is moved directly over cap 46 and the cap raised into contact with the printhead so as to form an air tight seal around the region in which the nozzles are located.

Figure 2:
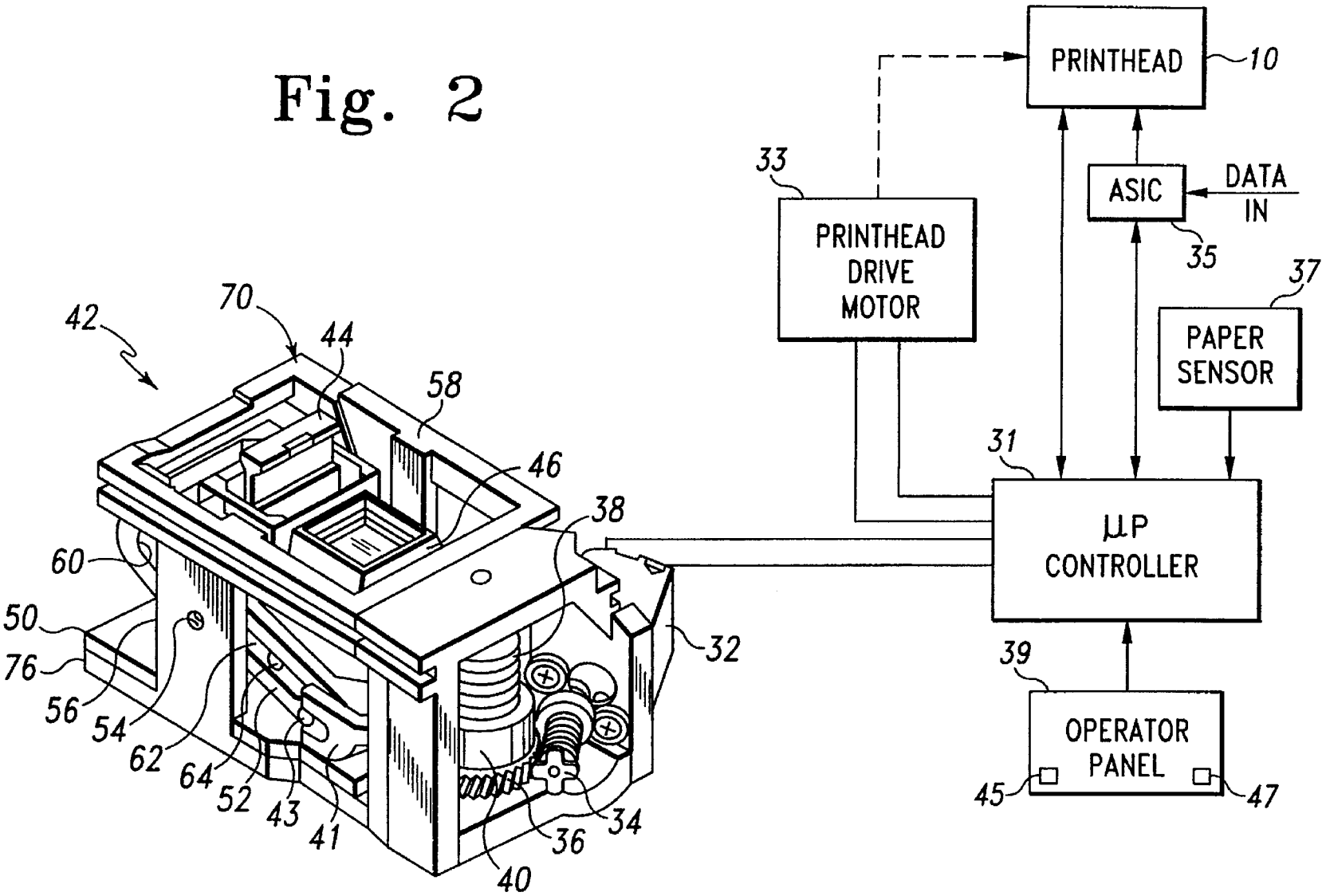
FIG. 2 shows a controller for controlling a printhead drive motor and a drive assembly for positioning a printhead wiper and cap, the drive assembly being shown in perspective.

The maintenance station 42 is shown in FIG. 2 and includes a drive assembly for moving wiper 44 and cap 46. Except for the wiper 44, maintenance station 42 may be like the maintenance station described in copending application Ser. No. 08/143,328. A controller 31 applies voltage pulses of a first or a second polarity to a DC motor 32 having a worm gear 34 mounted on its shaft. The worm gear drives a helical gear 36 that is interlocked with a power screw 38. A threaded nut 40 is mounted on the power screw and has two forked arms 41 for engaging pins 43 provided on a rocker element 52. The rocker element 52 is pivotally supported in holes 54 provided in side members 56 of a frame 58. The rocker element 52 has two pairs of slots 60, 62, the slots of a pair being located in opposing side walls of the rocker element. Two pins 64 ride in slots 62 to move the cap 46 vertically on a post similar to post 66 of FIG. 3. The pins 68 of FIG. 3 extend into the slots 60.

Pins 68 extend from opposite sides of a block 72 having a non-circular hole 74 therein so that the block may slide up and down on a non-circular post 66 that is attached to the base 76 of the maintenance station frame element. A spit cup 69 is attached to block 72. The spit cup is open at the top and a mounting beam 78 is attached to the bottom interior surface of the cup. The wiper 44 has a bottom opening therein so that it may fit over the mounting beam 78. A backstop 80 (shown in FIG. 3 only) is attached to an interior wall of the spit cup on the side toward which the wiper 44 is deflected as the printhead moves past the wiper during wiping of a monochrome printhead. As subsequently explained, a nozzle surface of a monochrome printhead is wiped in one direction only and the nozzle surface of a multi-color printhead is wiped in the opposite directly only. Backstop 80, in effect, braces the wiper and limits its deflection so that it applies a greater wiping force to a monochrome printhead than it does to a multi-color printhead.

The purpose of spit cup 69 is to collect ink ejected from the nozzles during execution of the maintenance routines described below. An absorbent pad 50 (FIG. 2) covers the major portion of the base of the maintenance station and collects liquid ink which might be spilled from the cup during transport of the printer, or may run out of the spit cup due to high usage.

Figure 3:
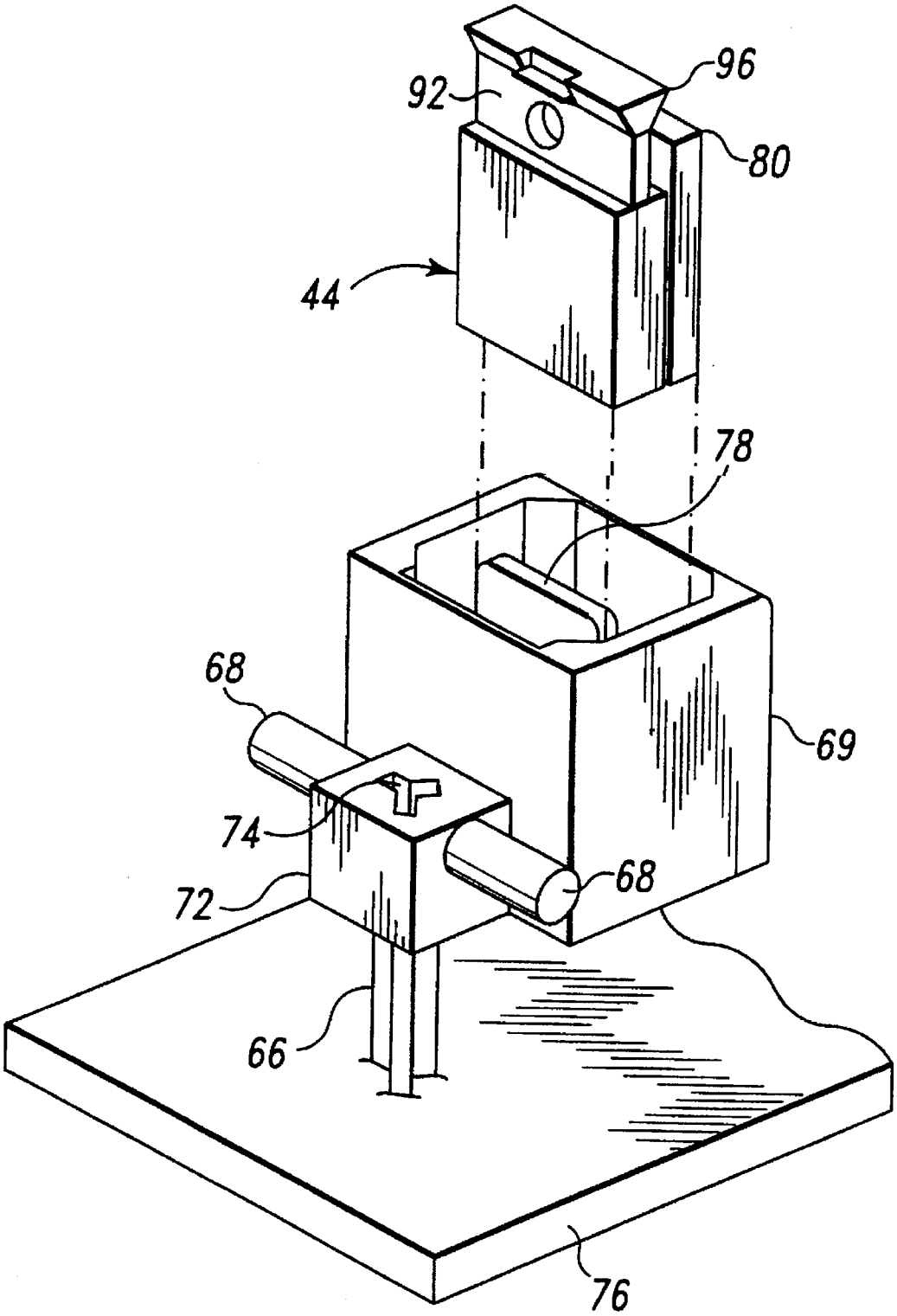
FIG. 3 is a perspective view of a printhead wiper assembly.

When motor 32 is energized, worm gear 34 rotates helical gear 36 thereby rotating power screw 38. As screw 38 rotates, the nut 40 moves up or down depending on the direction in which the motor 32 is energized. The arms 41 on the nut apply force to pins 43 to pivot rocker element 52 about the axis of holes 54. In FIG. 3, the rocker element applies a force to pins 68 to thus raise or lower the spit cup 69 and the wiper 44. At the same time, the rocker element moves the cap 46 in the opposite direction.

The maintenance station and the printhead are disposed on opposite sides of the plane in which a record is fed past the printhead. The motor 32 moves the rocker element 52 between three operative positions: a wiper active position where the wiper 44 extends about 0.5 mm above the path traversed by the nozzle surface of the printhead so that the wiper is bent over and wipes the nozzle surface as the printhead is moved past the wiper; a cap active position where the cap 46 presses against the nozzle surface when the printhead is positioned over the cap; and an inactive position where the cap and wiper are withdrawn from the printhead below the top surface of the maintenance station frame element 70.

Figure 5A:
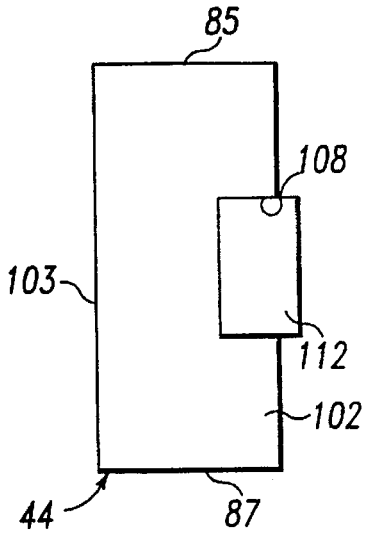
FIG. 5A is a top view of a printhead wiper according to the invention.
Figure 5B:
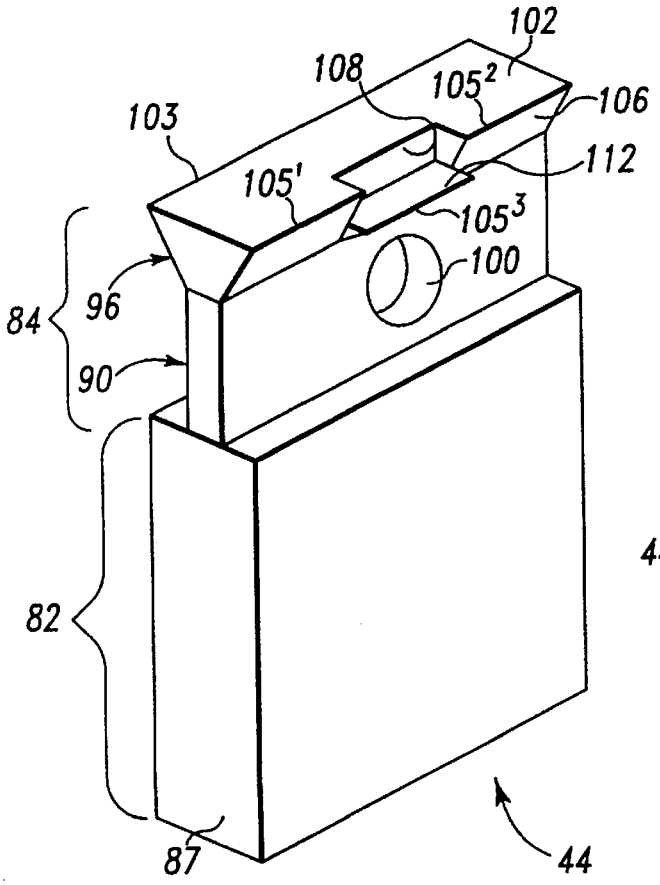
FIG. 5B is a perspective view of the printhead wiper.
Figure 5C:
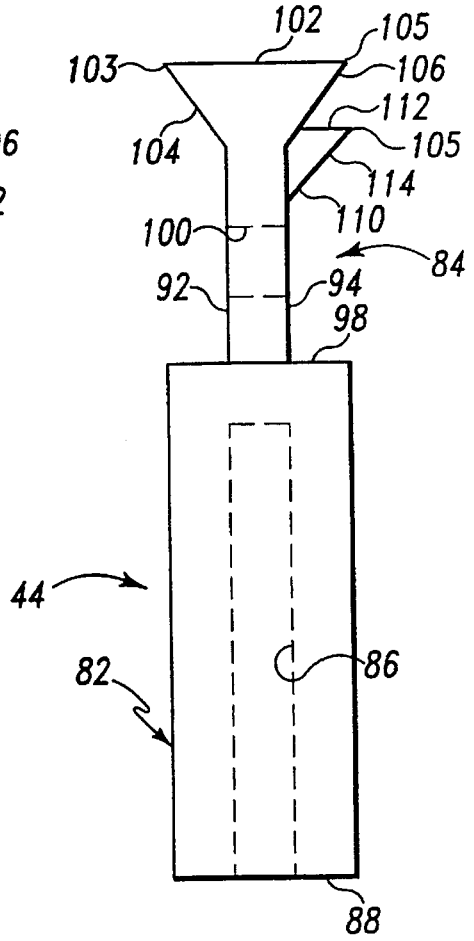
FIG. 5C is an end view of the printhead wiper.

Referring now to FIGS. 5A–5C, wiper element 44 is an elastic monolithic body having a mounting portion 82 (FIG. 5B) and a head portion 84. The wiper is made from Texin 480-A available from Miles, Inc., or from another material having similar properties of hardness, abrasion resistance, elasticity, and chemical resistance. Texin 480-A is a thermoplastic polyester based polyurethane having a durometer hardness of 85 Shore A. A Taber abrasion test (ASTM method C-501) on this material gives a 20 mg loss in a test run for 1000 cycles using an H-18 wheel with a 1000 gram load.

The ends of the mounting portion 82 and head portion 84 are coplanar and form flat parallel opposing end surfaces 85, 87 extending from the top of the wiper to the bottom.

Mounting portion 82 is a rectangular body having a slot 86 centrally located in a bottom surface 88 and extending upwardly toward head portion 84. The slot 86 is sized and shaped to receive the mounting beam 78 (FIG. 3) as the wiper is mounted on the spit cup 69.

The head portion 84 comprises a beam portion 90 (FIG. 5B) and a wiper portion 96. Beam portion 90 has parallel side surfaces 92, 94. The bottom of beam portion 90 joins the mounting portion 82 at the top surface 98 of the mounting portion. A hole 100 extends through the beam portion between surfaces 92 and 94. The hole 100 makes the beam portion more flexible, a desirable characteristic when wiping a multi-color printhead. The material from which the wiper is formed and the size of hole 100 are chosen to provide the optimum wiping force for wiping a multi-color printhead. The optimum wiping force for wiping a monochrome printhead is greater than that for wiping a multi-color printhead. During wiping of a monochrome printhead, backstop 80 limits deflection of wiper 44 to provide this greater force.

The wiper portion 96 is integrally joined at its bottom to the top of beam portion 90. The wiper portion has a first top surface 102 and two side surfaces 104 and 106 that diverge from opposite sides of beam portion 90 in the direction of top surface 102 so as to intersect the surface 102 at acute angles forming wiping edges 103, 105. That is, the angles between surface 102 and surface 104, and surface 102 and surface 106 are acute angles. The angles should be as small as possible consonant with the material used and the limitations of the process for molding the material. In a practical embodiment using Texin 480-A as the wiper material, the angles may be about 60°.

The wiper is formed with a notch or recess 108 extending downwardly into top surface 102 and side surface 106 thus dividing wiping edge 105 into two axially aligned wiping edges $\mathbf{105^1}$, $\mathbf{105^2}$. A projection 110 is provided in recess 108, the projection having a first surface 112 which comprises a second top surface of the wiper that is parallel to, but spaced downwardly from, the first top surface 102. Projection 110 has a side surface 114 diverging outwardly from beam portion 84 and intersecting surface 112 at an acute angle to form a further wiping edge $\mathbf{105^3}$ displaced downwardly from and lying parallel to the wiping edges $\mathbf{105^1}$ and $\mathbf{105^2}$.

Figure 4B:
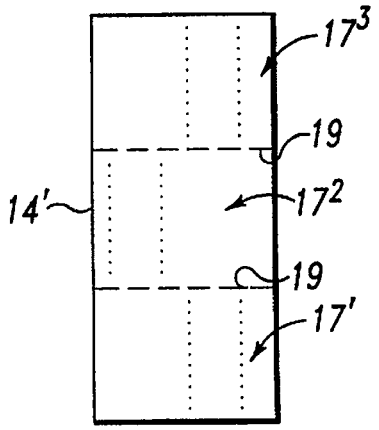

As shown in FIG. 4B, the wiping edge $\mathbf{105^3}$ traverses a path indicated by broken lines 19 to wipe the nozzles of nozzle group $\mathbf{17^2}$.

In a typical embodiment the wiper 44 measures 15.97 mm between top surface 102 and bottom surface 88 and 9.5 mm between the end surfaces 85, 87. The walls of mounting portion 82 surrounding slot 86 are 1 mm thick. The beam portion 90 is 1 mm thick measured between surfaces 92 and 94 and 3 mm high measured from surface 98 to the point where surface 114 diverges. Surface 102 measures 3 mm between its intersections with surfaces 104 and 106. The wiper portion 96 measures 2.47 mm between surface 102 and the point where surface 114 diverges from surface 94. The vertical distance between surfaces 102 and 112 is 1 mm. As viewed in FIG. 5C, the surface 112 extends 0.25 mm further to the right than the surface 102. The hole 100 is 3 mm in diameter. The foregoing dimensions are given by way of example only.

FIG. 1 shows the wiper 44 mounted in the maintenance station with an orientation that places the wiping edge 103 on the inboard or left side of the wiper and the wiping edges $\mathbf{105^1}$, $\mathbf{105^2}$ and $\mathbf{105^3}$ on the outboard or right side. To wipe a monochrome printhead, controller 31 (FIG. 2) energizes the printhead carriage drive motor 33 (FIG. 2) to move the printhead to a position to the left of wiper 44. The controller 31 then energizes the maintenance station drive motor 32 in a direction which causes the wiper 44 to be driven upwardly until it extends into the path of travel of the nozzle surface. The controller then energizes the printhead carriage drive motor 33 to drive the printhead to the right. As the printhead moves past the wiper it deflects the wiper until the wiper engages back stop 80 (shown in FIG. 3 only) and wiping edge 103 wipes the nozzle surface. When the wiping edge 103 has wiped the nozzles, the controller 31 stops the printhead carriage drive motor. At this time the nozzles 15 (FIG. 4A) are over the spit cup 69. This completes one wipe of the monochrome printhead. Experience has shown that normally a single wipe is sufficient to clean a monochrome printhead. After the wipe is completed, the wiper is lowered and the printhead is moved over the spit cup. The controller then applies signals to the printhead to cause each nozzle to fire a number of times to clear the nozzles of any debris, including dried ink that may have accumulated in them. As subsequently explained the action of the maintenance station after the nozzles have been fired varies according to the status of the printer. If there is no data to be printed, controller 31 energizes motors 35 and 32 to move the printhead over cap 46 and raise the cap. If there is data to be printed the controller 31 energizes motor 32 to lower the wiper to the mid-position where the wiper and cap are both out of contact with the printhead.

To wipe a multi-color printhead, controller 31 energizes the printhead carriage drive motor 35 to move the printhead to the right of the wiper 44 as viewed in FIG. 1. Next controller 31 energizes motor 32 to raise the wiper into the path of travel of the nozzle plate. The carriage drive motor 33 is then energized to move the printhead to the left. As the printhead moves to the left, it deflects the wiper so that wiping edges $\mathbf{105^1}$, $\mathbf{105^2}$ and $\mathbf{105^3}$ wipe the nozzles of nozzle groups $\mathbf{17^1}$, $\mathbf{17^3}$ and $\mathbf{17^2}$, respectively. The printhead movement is stopped as soon as the wiping edge $\mathbf{105^3}$ has wiped past the nozzle group $\mathbf{17^2}$. The wiper is lowered and the printhead is moved so that the nozzles $\mathbf{17^1}$, $\mathbf{17^2}$ and $\mathbf{17^3}$ are over the spit cup 69. After a wipe of a multi-color printhead, the controller 31 may or may not apply signals to the printhead to fire each nozzle a number of times to clear the nozzles.

The controller 31 may be a conventional microprocessor including A/D conversion and a memory, at least a portion of the memory being non-volatile random access memory (NVRAM). The NVRAM stores the instructions comprising the maintenance routines as well as various constants required in executing the routines.

As shown in FIG. 2, the controller receives input signals from several sources. A page sensor 37 is connected to an input of the controller. Sensor 37 may be a mechanical switch having an arm extending through a hole in middle frame 28 so as to sense the presence of a sheet of paper in the paper feed path.

The controller must determine the type of printhead installed in the printer so that it will execute a routine which provides optimum maintenance for the printhead. A typical monochrome printhead may have 56 nozzles whereas a tri-color printhead may have 48 nozzles. Conventionally, a resistive heating element is provided for each nozzle to heat the ink to cause it to expand and be ejected from the nozzle. By sensing the resistance in the printhead the controller may determine the type of printhead installed in the printer.

An operator's control panel 39 is provided with an Install/Change push-button switch 45 and a Prime push-button switch 47 and these switches provide further input signals to the controller 31 as subsequently described.

Figure 6:
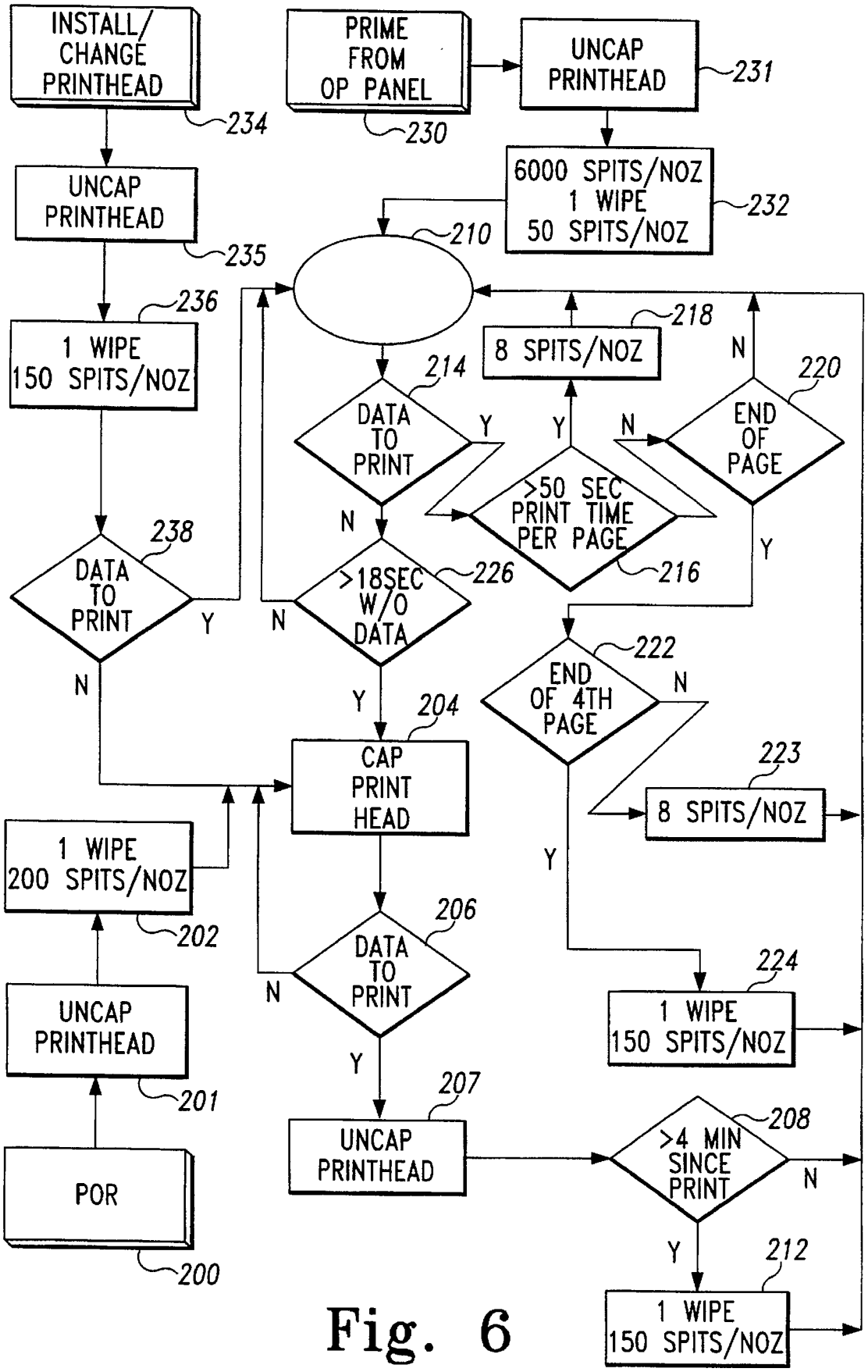
FIG. 6 shows a flow diagram of a maintenance routine executed by the controller of FIG. 2 to control maintenance of a monochrome printhead; and, FIGS. 7A and 7B, when arranged as shown in FIG. 7C, comprise a flow diagram of a maintenance routine executed by the controller to control maintenance of a color printhead.

FIG. 6 illustrates the routine executed by controller 31 to maintain a monochrome printhead. At the time power is turned on, the cap 46 will be in the raised position capping the printhead. When power is turned on, the controller 31 executes a power-up reset (step 200) during which it senses the printhead to determine whether it is a monochrome or multi-color printhead. If step 200 determines that a monochrome printhead is installed, the controller moves the cap and wiper to the inactive position (step 201) a monochrome printhead wipe is executed (step 202) as previously described, and after the wipe is completed each nozzle is fired 200 times to clear the nozzles. Although not shown in the drawing for the sake of clarity, the controller 31 includes a timer (TLP) which is reset each time any nozzle is fired, and thus times the interval since the last "printing". TLP is reset at step 202. Motor 33 is then energized (step 204) to move the printhead over the cap and motor 32 is energized to raise the cap into the capping position. The controller begins sensing the ASIC 35 (step 206) to determine if there is data to print. The printhead remains capped and the controller continues to sense the ASIC until the ASIC sets an indicator indicating that data is ready to print. When data is ready to print, TLP is tested (step 208) to determine if more than 4 minutes has elapsed since the nozzles were last fired. If 4 minutes has not elapsed, the controller enables the ASIC (step 210) so that data in the ASIC may be transferred to the printhead nozzle heaters to print the data. On the other hand, if step 208 determines that more than 4 minutes has elapsed since the last firing of any nozzle, step 212 is executed to wipe the printhead and fire each nozzle 150 times before the ASIC output is enabled.

Controller 31 continues to monitor the data ready indicator in the ASIC (step 214) after the ASIC is enabled. When there is data to print, step 216 determines if more than 50 seconds is required to print a page. The paper sensor 37 sets an indicator bit and enables a timer (TIP) in controller 31 when it senses the leading edge of a sheet of paper in the record feed path, and resets the bit and stops the timer when it senses the trailing edge. At step 216 TIP is sensed to determine if more than 50 seconds has elapsed since the start of a page. If 50 seconds has elapsed, the ASIC output to the printhead is disabled and controller 31 energizes the printhead motor 33 to move the printhead over the spit cup 69. The controller then causes the nozzles to fire 8 times each (step 218). After the nozzles are fired, the controller advances to step 210 and again enables the output of the ASIC. Since a specific printing application may not require firing of all nozzles within a 50 sec interval, steps 216 and 218 are provided to ensure that all nozzles are fired, thus preventing ink from drying in the nozzles.

If step 216 determines that 50 sec has not elapsed since the start of the page, the paper sensor indicator bit is tested at step 220 to determine if the end of a page has been reached. If the end of the page has not been reached the controller 31 continues to monitor the data ready indicator in the ASIC (step 214) and the ASIC outputs data to the printhead.

The loop represented by steps 210, 214, 216 and 220 is repeatedly executed until (1) 50 sec has elapsed as described above, (2) the end of page has been reached, or (3) there is no data in the ASIC to print. If step 220 detects an end of page, a page counter is incremented and tested at step 222 to determine if four pages have been printed. If four pages have not passed through the printer, step 223 is executed. The printhead is moved over the spit cup 69 and signals are sent to the printhead fire each nozzle 8 times. On the other hand, if four pages have been printed, the page counter is reset, the ASIC is prevented from sending data to the printhead, and a wipe followed by 150 firings of each nozzle is carried out (step 224) before the routine returns to step 210.

Controller 31 includes a timer (NDP) for tolling intervals of time in which the ASIC holds no data ready for printing. NDP is reset each time step 214 is executed if the ASIC holds data for printing. If there is no data to print, step 226 is executed to determine if the timer has tolled an 18 sec interval. If less than 18 sec has elapsed since the ASIC last held data to print, the controller 31 repeatedly executes the loop including steps 214 and 226. If the ASIC should develop data ready to print during the 18 sec interval, this is detected at step 214 and the routine again branches to step 216.

If 18 sec should elapse during which time the ASIC holds no data for printing, the test of NDP at step 226 will prove true and the routine will advance to step 204 to cap the printhead by first energizing motor 33 to move the printhead over cap 46 and then energizing the motor 32 to raise the cap into contact with the printhead.

Under some conditions such as an abnormally dusty or extremely hot and dry environment, the normal maintenance routine may not adequately maintain the printhead. The Prime push-button switch 47 is provided on the operator's panel 39 to enable the operator to interrupt the normal maintenance routine and initiate a prime operation if the print quality should deteriorate. When the operator presses the Prime pushbutton (step 230) the normal maintenance routine is interrupted and controller 31 advances directly to the prime operation. ASIC transfers of data to the printhead are suspended. The motor 32 is energized (step 231) to move the wiper and cap to the inactive position if they are not already in the inactive position and the printhead drive motor 33 is energized to move the printhead so that the nozzles are over the spit cup 69 and to one side of wiper 44.

Controller 31 then fires each nozzle 6000 times (step 232) directly into the spit cup. The wet ink dissolves any dried ink in the nozzles and flushes from the nozzles any debris accumulated therein. A wipe cycle is then carried out by moving the printhead to the left of the wiper 44 as viewed in FIG. 1, raising the wiper, and moving the printhead to the right so that the wiping edge 103 wipes ink and debris from the printhead. After the printhead is wiped, each nozzle is fired 50 times and controller 31 advances to step 210 to enable the transfer of data from the ASIC to the printhead.

When controller 31 senses a change in ink cartridges (step 234) and that change is from a multi-color to a monochrome cartridge, the controller carries out the operations to uncap the printhead (step 235) and accomplish one wipe of the new monochrome cartridge (step 236) after which each nozzle is fired 150 times. The data ready indicator in the ASIC is then sensed (step 238) to see if the ASIC holds data for printing. If there is data to be printed, the routine moves to step 210 to enable the ASIC for data transfer. On the other hand, if step 238 determines that there is no data to print, the routine moves to step 204 where the printhead is capped.

The sensing of a change of ink cartridges (step 234) actually involves a plurality of steps as explained below with reference to steps 300–307 shown in FIGS. 7A and 7B.

Figure 7A:
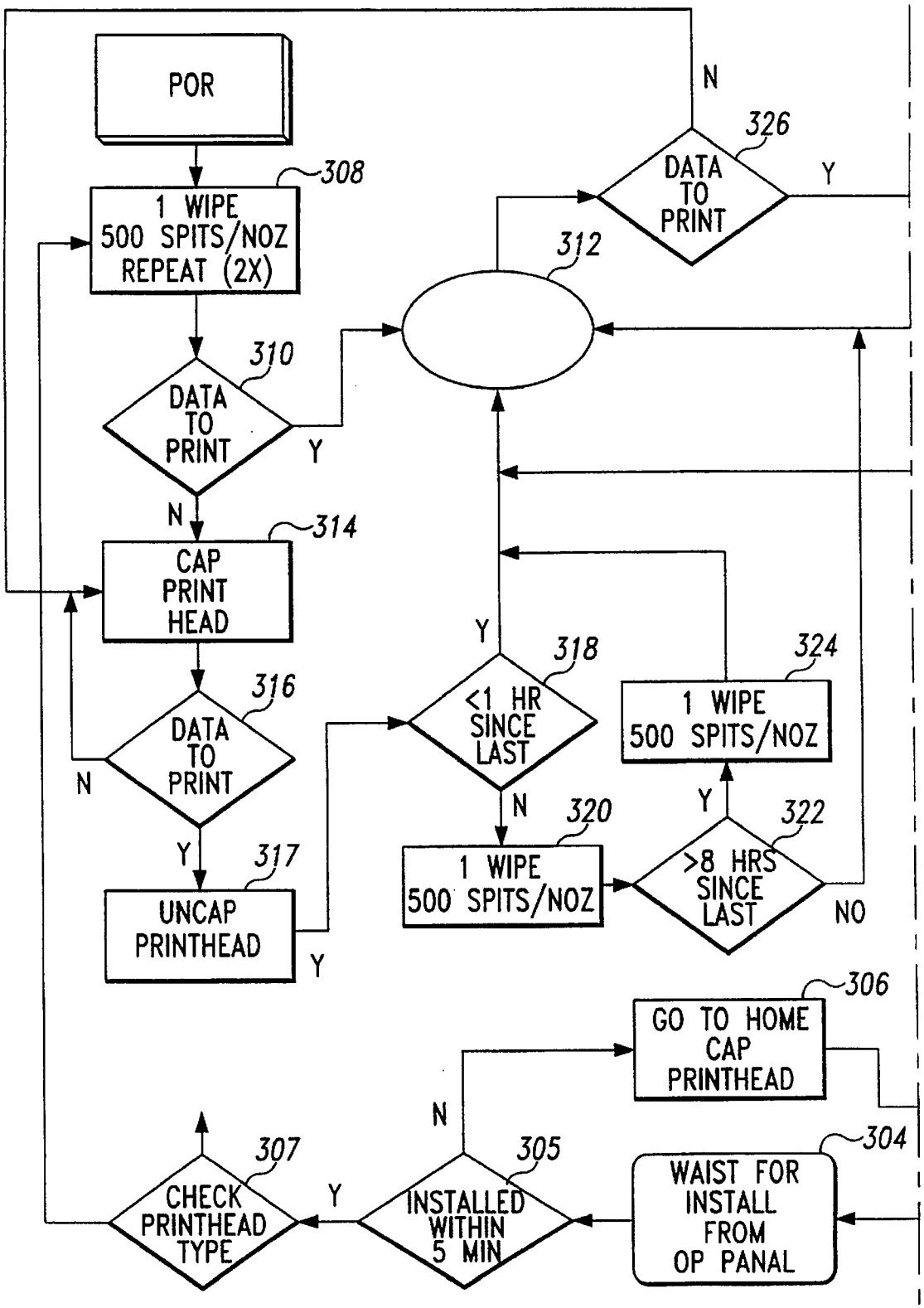
Figures 7B, 7C:
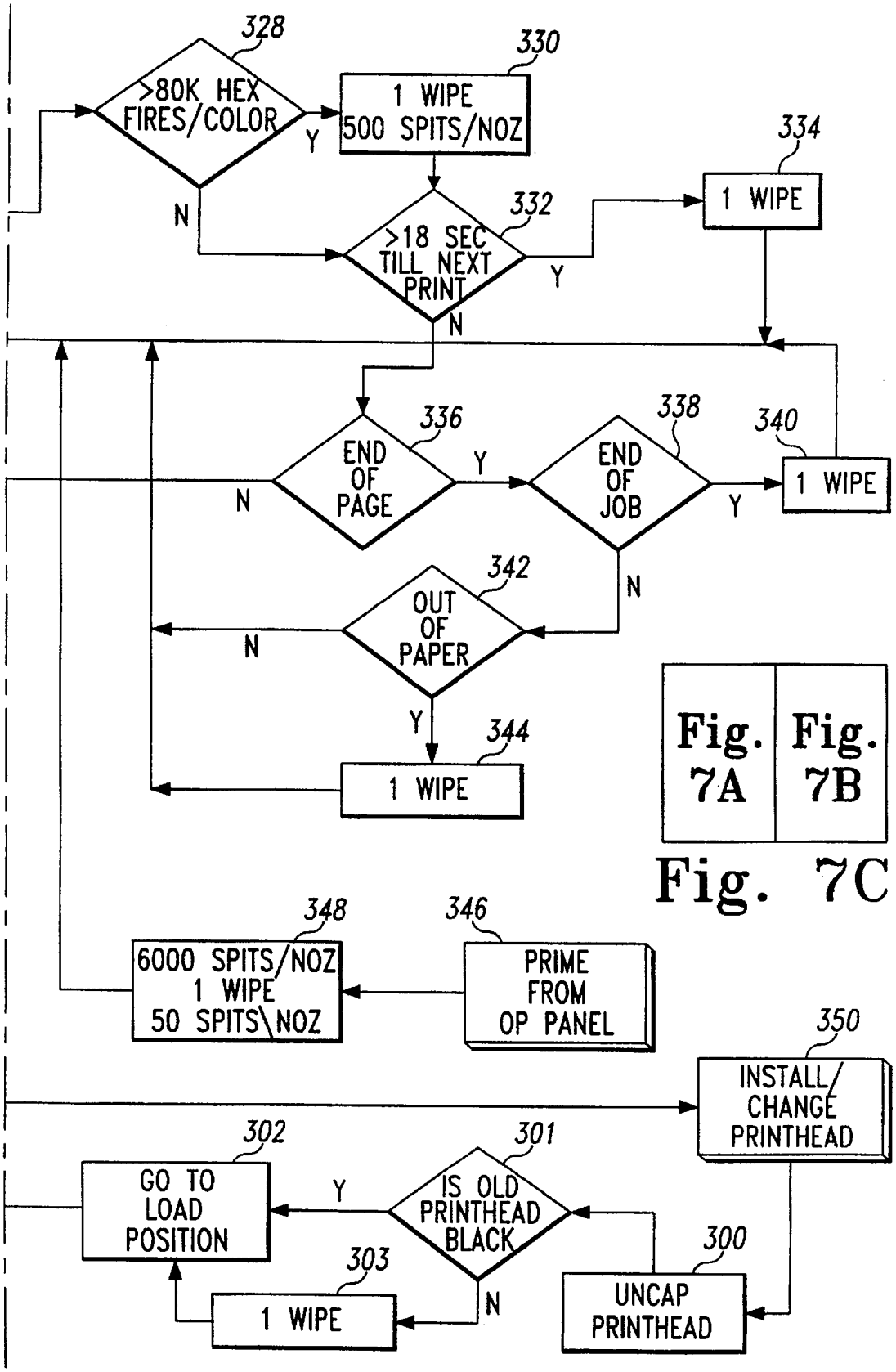

FIGS. 7A and 7B show the maintenance routine for a multi-color printhead as well as the steps executed during a change in cartridges. To initiate a change in cartridges, the operator actuates the Install/Change push-button switch 45 on the control panel (step 350). In response to actuation of the switch, the controller 31 uncaps the printhead (step 300) and senses the printhead currently in the printer (step 301) to determine if it is a monochrome or a multi-color cartridge.

If the test at step 301 determines that the present cartridge is monochrome, it does not require wiping before removal and storage. The routine advances to step 302 where the printhead drive motor 33 is energized to move the printhead to a load position. The load position may be at or near the center of the record feed path to give the operator easy access to the printhead. If step 301 determines that the present cartridge is a multi-color cartridge, it should be wiped before storage. Step 303 is executed to perform the wipe before the printhead is moved to the load position.

After moving the printhead to the load position the routine waits at step 304 and during the wait, senses for a second actuation of the Install/Change switch 45. During this wait the operator may remove the old cartridge and install the new cartridge. After the new cartridge is installed, the operator should actuate the Change/Install switch 45 again. During the time the routine is waiting, it times the wait interval (step 305). If the operator does not actuate the Change/Install switch a second time with 5 minutes of the first actuation, the controller assumes that a cartridge is in place and should be capped. At the end of the 5 minute interval the printhead drive motor 33 is energized to move the printhead over cap 46 and motor 32 is energized to raise the cap (step 306).

If the operator actuates the Install/Change switch the second time within the 5-minute interval timed at step 305, the controller senses the printhead (step 307) to determine if the new cartridge is monochrome or multi-color. If step 307 determines that the cartridge is a monochrome cartridge, the routine moves to step 235 of the monochrome maintenance routine shown in FIG. 6. On the other hand, if step 307 determines that a multi-color cartridge is now in the printer, the routine moves to step 308 where two wipes are performed, each followed by 500 fires of each nozzle.

To execute step 308, controller 31 energizes motor 32 to move the wiper 44 and cap 46 to the inactive position. Controller 31 then energizes printhead drive motor 33 to move the printhead to a position to the right of wiper 44 as viewed in FIG. 1. Motor 32 is then energized to raise the wiper and motor 33 is energized to move the printhead to the left until the wiper is past the nozzles of nozzle group $17^2$. As the printhead is moved to the left, it deflects the wiper and wiping edges $105^1$–$105^3$ wipe the nozzles in nozzle groups $17^1$–$17^3$. Each nozzle is then fired 500 times. After the nozzles have been fired, the above steps are repeated to accomplish the second wipe and the second firings of the nozzle.

When printer power is first turned on, the controller 31 executes a power-on reset sequence as described with reference to FIG. 6, uncaps the printhead, and if the controller determines that a multi-color cartridge is in the printer the maintenance routine advances to step 308 to perform two wipes each followed by 500 firings of each nozzle.

After step 308 is completed, controller 31 checks the ASIC data ready indicator (step 310) to determine if there is data to be printed. If there is no data to print, motors 32 and 33 are energized (step 314) to move the printhead over the cap 46 and raise the cap 46 to cap the printhead. After the printhead is capped, the controller 31 begins monitoring the ASIC data ready indicator (step 316), the printhead remaining capped as long as the monitoring detects that no data is ready to be printed.

When step 316 detects that there is data to be printed, the printhead is uncapped (step 317) and the time-since-last-print counter TLP is tested (step 318) to determine if less than one hour has elapsed since the last print or firing of the nozzles. If less than one hour has elapsed, the ASIC is enabled (step 312) so that the data may be transferred to the printhead. If at least one hour has elapsed since the last firing of the nozzles then at step 320 the controller controls motors 32 and 33 to cause one wipe of the printhead, and controls the nozzles to fire 500 times each. The TLP counter is not reset after these firings.

Since the movement of the printhead wiper and cap to accomplish a wipe should be evident from the description set forth above, these movements will henceforth not be described in detail. In like manner, the positioning of the wiper/cap for capping, or during periods when the ASIC is enabled to feed data to the printhead will not be described since these operations should now be evident from the foregoing description.

After step 320 is completed, the TLP counter is tested again (step 322) to determine if more than eight hours has elapsed. If more than eight hours has not elapsed, then TLP is reset and the routine moves to step 312 to enable the transfer of data from the ASIC to the printhead. If more than eight hours has elapsed, step 324 is executed to wipe the printhead again and fire each nozzle another 500 times before the transfer of data is enabled at step 312.

When the transfer of data from the ASIC is enabled at step 312, the controller 31 continues to monitor the data ready indicator in the ASIC (step 326) and if the ASIC holds data ready for printing the cap and wiper are moved to the inactive position.

The controller 31 includes three counters, one for each group of color nozzles $17^1$–$17^3$. Each time the ASIC sends data to the printhead to fire a nozzle in a particular color group, the counter assigned to that group is incremented. At step 328 the contents of the counters are tested and if any counter contains a count greater than 80000 (Hex), step 330 is executed to suspend transfer of data from the ASIC to the printhead, wipe the printhead, and fire each nozzle 500 times. This clears any nozzles which may not be fired during a specific application and wipes away any ink which may have accumulated around the nozzles.

If step 328 determines that there have been less than 80000 (Hex) firings of the nozzles in every color group, the routine advances directly to step 332 but if more than 80000 (Hex) firings of nozzles in a color group have occurred step 330 is executed before the routine advances to step 332.

Step 332 tests the TLP counter to determine if more than 18 sec has elapsed since the last firing of any nozzle. This might occur, for example, in the event of a malfunction or a very complex print job in the processor sending data to the printer. To retard the drying of ink at the nozzles, step 334 is executed to wipe the printhead one time. The routine returns to step 326 and if no data is ready to print motor 32 is energized to raise the cap to seal the nozzle environment.

Normally, the test at step 332 should prove false and in this event the indicator bit controlled by sensor switch 37 is tested at step 336 to determine if the end of a page has been reached. If not, the program loops back to step 326.

During printing of a single page, the controller repeatedly executes the loop including steps 312, 326, 328, 332 and 336. If the ASIC should run out of data, this is detected at step 326 and the printhead is capped at step 314. If, during the printing of a page the 80000th (Hex) firing of nozzles in one color group should occur, step 330 is executed to wipe the printhead and clean the nozzles. When the end of a page is reached, an exit is made from the loop at step 336 and step 338 is executed to determine if the end of the job has been reached. The end of the job is normally signalled by an end-of-job command from the data source. If the end of job command is received, the printhead is wiped at step 340. The routine returns to step 326 and since the end of the job has been reached, that is, there is no more data to print, the routine advances to step 314 to cap the printhead.

Controller 31 includes a timer which is started when the end of page is detected at step 336. At step 338, if the end-of-job command is not received within a short interval of time, the timer times out and the routine advances to step 342.

Step 342 determines if the printer is out of paper. Controller 31 is provided with a counter which times an interval between the time paper sensor switch 37 opens at the end of one page and the time the switch should be closed by the leading edge of the next succeeded page. At step 342, controller waits until the timer times out and senses the status of the switch. If the switch is not closed it is an indication that the paper supply is exhausted. The printhead is wiped at step 344. The out-of-paper condition forces the data ready indicator to a false indication that there is no data ready to print. When the maintenance routine loops back to step 326, this false indication causes the routine to branch to step 314 to cap the printhead.

To summarize the maintenance routine for a multi-color printhead, when there is no data to print, the printhead remains capped (step 314). When data is ready for printing, the controller determines the time since any nozzle was last fired (steps 318, 322) and performs maintenance (steps 320, 324) depending on the length of time since the nozzles were last fired.

Once the maintenance steps are completed, controller 31 normally repeatedly executes steps 326, 328, 332 and 336 while the printhead is printing one page of data. When the end of a page is detected (step 336), and an end of the job has been reached (step 338) the printhead is wiped (step 340). In this case the next execution of step 326 will find no data ready to print and the routine returns to the loop comprising steps 314 and 316 to wait for more data to be readied for printing. When an end of page is detected and the printer is out of paper (step 342) the printhead is wiped (step 344) and since the data ready indicator is forced to indicate that no data is ready for printing (step 326) the routine returns to the loop comprising steps 314 and 316 to wait for the paper supply to be replenished.

The operator may initiate a prime operation from the control panel to clear and wipe the nozzles. In response to actuation of the Prime push-button switch 47 (step 346) the controller 31 executes step 348 to fire each nozzle 6000 times, wipe the printhead once, and then fire each nozzle 50 times. The program then advances to step 326 and if there is no data to print the printhead is capped at step 314 and waits until data is ready for printing.

From the foregoing description it is seen that the present invention provides a novel maintenance system for controlling maintenance of either a multi-color or monochrome printhead with the intervals between wiping/cleaning being determined by the differing requirements of monochrome versus color inks. The system includes a novel wiper which is used to wipe either a monochrome or a multi-color printhead without contaminating ink of one color with ink of another color, and a backstop for the wiper so that different wiping forces may be applied to wipe the two types of printheads.

While a preferred embodiment of the invention has been described in detail by way of illustration, it will be understood that various modifications and substitutions may be made in the described embodiment without departing from the spirit and scope of the invention as defined by the appended claims.

We claim:

1. A printhead wiper for wiping ink-jet printheads, said wiper comprising a resilient body having a beam portion and a head portion, said head portion having a first non-coplanar upper surface and a second non-coplanar upper surface, wherein at least one of said first non-coplanar upper surface and said second non-coplanar upper surface has a first surface portion spaced apart from a second surface portion, and said beam portion having a plurality of side surfaces diverging from a first side of said beam portion, and wherein each of said plurality of side surfaces intersects one of said first and said second of the non-coplanar upper surfaces at acute angles to form at least three printhead wiping edges.

2. A printhead wiper as claimed in claim 1 wherein said first non-coplanar upper surface and said second non-coplanar upper surface are flat surfaces lying in substantially parallel planes.

3. A printhead wiper as claimed in claim 1 wherein said head portion has a further side surface diverging from a second side of said beam portion and intersecting one of said first non-coplanar upper surface and said second non-coplanar upper surface at an acute angle to form a fourth printhead wiping edge.

4. A printhead wiper as claimed in claim 3 wherein said side surfaces and said further side surface intersect said first upper surface to form at least three of said printhead wiping edges.

5. A printhead wiper as claimed in claim 3 wherein said further side surface intersects said first upper surface to form said fourth printhead wiping edge.

6. A printhead wiper as claimed in claim 1 wherein a first and a second of said wiping edges are coaxially aligned and spaced apart, one from the other.

7. A printhead wiper as claimed in claim 6 wherein a third of said wiping edges is displaced from and lies parallel to said first and said second of said wiping edges.

8. An ink-jet printer for printing on record pages passing through said printer, said printer including a printhead carrier for selectively carrying a monochrome or a multi-color ink-jet cartridge back and forth along a path; a resilient wiper movable into the path of a cartridge carried by said printhead carrier so that said wiper is deflected and wipes a surface of a cartridge carried by said printhead carriage as said cartridge is moved past said wiper, said surface having ink-jet nozzles therein; and control means for controlling the wiping of said surface, said control means including means for sensing whether a cartridge carried by said printhead carrier is a monochrome cartridge or a multi-color cartridge, first means responsive to said sensing means for, in sequence, (1) moving said printhead carrier to a first side of said wiper, (2) raising said wiper into said path, and (3) moving said printhead carrier past said wiper so that said wiper is deflected in a first direction when said sensing means senses a monochrome cartridge in said printhead carrier, and second means responsive to said sensing means for, in sequence (1) moving said printhead carrier to a second side of said wiper, (2) raising said wiper into said path, and (3) moving said printhead carrier past said wiper so that said wiper is deflected in a second direction when said sensing means senses a multi-color cartridge in said printhead carrier.

9. An ink-jet printer as claimed in claim 8 wherein said control means includes means for sensing when data is ready for printing with a multi-color cartridge, and means for wiping said surface and firing said ink-jet nozzles before beginning said printing, the number of times said surface is wiped being dependent on an interval of time elapsing since the last firing of said ink-jet nozzles.

10. An ink-jet printer as claimed in claim 8 and further comprising a backstop positioned adjacent said wiper for limiting deflection of said wiper in said first direction whereby said wiper applies a wiping force to a monochrome printhead that is greater than a wiping force said wiper applies to a multi-color printhead.

11. An ink-jet printer as claimed in claim 10 and further comprising a spit cup on which said wiper and backstop are mounted, said control means including drive means for moving said spit cup to thereby raise said wiper.

12. An ink-jet printer as claimed in claim 8 wherein said control means includes means responsive to said sensing means for carrying out a first maintenance sequence when a monochrome cartridge is sensed and means for carrying out a second maintenance sequence, different from said first maintenance sequence, when a multi-color cartridge is sensed.

13. An ink-jet printer as claimed in claim 12 and further comprising a spit cup on which said wiper and backstop are mounted, said control means including drive means for moving said spit cup to thereby raise said wiper.

14. An ink-jet printer as claimed in claim 13 wherein said control means includes means operative during said first sequence for wiping said surface and firing said nozzles before printing when at least a first predetermined time has elapsed since any nozzle was last fired, means operative during said first sequence for firing said nozzles when greater than a predetermined interval of time elapses during the printing of a single page, and means operative during said first sequence for firing said nozzles after a fixed number of record pages have been printed.

15. An ink-jet printer as claimed in claim 14 and further comprising a cap for capping said ink-jet nozzles, said control means including means operative during said second sequence for wiping said surface and moving said cap to cap said ink-jet nozzles when the end of a printing job is reached, there are no more record pages on which to print, or there is data to print and a fixed interval of time elapses during which no ink-jet nozzles are fired.

16. An ink-jet printer as claimed in claim 13 and further comprising a cap for capping said ink-jet nozzles, said control means including means operative during said second sequence for wiping said surface and moving said cap to cap said ink-jet nozzles when the end of a printing job is reached, there are no more record pages on which to print, or there is data to print and a fixed interval of time elapses during which no ink-jet nozzles are fired.

17. An ink-jet printer as claimed in claim 8 and further comprising a manually operable control panel switch, said control means including means responsive to a first actuation of said switch to move said printhead carrier to a load position where a cartridge carried by said carrier may be replaced by another cartridge, said sensing means being responsive to a second actuation of said switch for determining whether said another cartridge is a monochrome or a multi-color cartridge, said control means including means responsive to said sensing means for wiping said surface of said another cartridge and firing the nozzles a first number of times when said another cartridge is a monochrome cartridge and means responsive to said sensing means for wiping said surface of said another cartridge and firing the nozzles a second number of times when said another cartridge is a multi-color cartridge.

18. An ink-jet printer as claimed in claim 17 wherein said surface is wiped only one time when said another cartridge is a monochrome cartridge and said surface is wiped more than one time when said another cartridge is a multi-color cartridge.

19. An ink-jet printer as claimed in claim 18 wherein the ink-jet nozzles of said another cartridge are fired a first number of times when said another cartridge is a monochrome cartridge and the ink-jet nozzles of said another cartridge are fired a second number of times, greater than said first number of times, after each wipe of said surface when said another cartridge is a multi-color cartridge.

20. A printhead wiper for wiping the nozzles of an ink-jet printhead having three groups of nozzles as the groups of nozzles are moved along three respective parallel paths past the wiper, said wiper being characterized in that said wiper has three separate wiping edges, a first and a second of said wiping edges being coaxially aligned along an axis and spaced one from another, and a third of said wiping edges being displaced from, but parallel to, said axis, whereby each of said wiping edges wipes only the nozzles of a respective one of said groups of nozzles.

21. A printhead wiper as claimed in claim 20 wherein said wiper comprises a resilient body having a beam portion and a head portion, said head portion having first and second flat upper surfaces disposed in different planes, said head portion having at least one side surface diverging from said beam portion and intersecting one of said flat upper surfaces at an acute angle to form one of said three wiping edges.

* * * * *